United States Patent [19]

Sundvall et al.

[11] Patent Number: 4,722,277

[45] Date of Patent: Feb. 2, 1988

[54] SAFETY MEANS FOR AN ORDNANCE FUZE

[75] Inventors: Kenneth Sundvall; Stig Risberg, both of Eskilstuna, Sweden

[73] Assignee: Affarsverket FFV, Eskilstuna, Sweden

[21] Appl. No.: 24,961

[22] Filed: Mar. 12, 1987

[30] Foreign Application Priority Data

Mar. 13, 1986 [SE] Sweden ..... 8601181

[51] Int. Cl.[4] ..... F42C 15/34

[52] U.S. Cl. ..... 102/255; 102/248

[58] Field of Search ..... 102/253, 254, 255, 256, 102/258, 257, 238, 248, 232, 221

[56] References Cited

U.S. PATENT DOCUMENTS

| | | | |
|---|---|---|---|
| 3,170,404 | 2/1965 | Swaim et al. | 102/248 |
| 3,181,467 | 5/1965 | Jacob et al. | 102/248 |
| 3,620,164 | 11/1971 | Carroll | 102/235 |
| 4,036,144 | 7/1977 | Meek | 102/254 |
| 4,154,169 | 5/1979 | Petiteau | 102/238 X |
| 4,320,705 | 3/1982 | Petiteau | 102/232 |
| 4,430,938 | 2/1984 | Jandér | 102/248 X |

FOREIGN PATENT DOCUMENTS

| | | | |
|---|---|---|---|
| 1198840 | 12/1959 | France | 102/255 |
| 2563622 | 10/1985 | France | 102/254 |

*Primary Examiner*—David H. Brown

*Attorney, Agent, or Firm*—Fleit, Jacobson, Cohn & Price

[57] ABSTRACT

A safety means for an ordnance fuze. The arrangement includes an arming rotor (1) which is held in a safe position (A) by means of a half-shaft (6) which in the safe position of the rotor engages a first recess (7) located in the rotor. A clock mechanism (9) is provided so as to rotate the half-shaft (6) about its axis to a rotational position in which it no longer engages the rotor (1), thereby enabling the rotor to be rotated to its armed position. The rotor has provided therein a second recess (11) into which the half-shaft (6) is able to rotate should it be rotated at an excessively high speed, thereby returning the rotor to its safe position.

3 Claims, 4 Drawing Figures

SAFETY MEANS FOR AN ORDNANCE FUZE

TECHNICAL FIELD

The present invention relates to a safety means for an ordnance fuze. The safety means is of the kind which includes an arming rotor which can be turned from a safe position to an armed position. The rotor is held in its safe position by means of a locking device which has the form of a shaft of substantially semi-circular cross-section, i.e. a half-shaft and which engages a first recess provided in the periphery of the rotor. A first drive means is arranged in one given rotational direction to rotate the half-shaft about its axis out of the first recess to a position in which the rotor is free to rotate. A second drive means is provided for rotating the rotor from its free position to the aforesaid armed position of the rotor, with the half-shaft sliding against the guide surface on the rotor.

BACKGROUND PRIOR ART

A safety means of this kind is known from U.S. Pat. No. 4,036,144. The specification teaches an arming rotor that has a plurality of half-shafts, each of which is intended to be rotated about its axis in a first rotational direction by means of a motor provided herefor, to a position in which the rotor is free to rotate. If no torque is applied to the rotor in conjunction herewith, each half-shaft is rotated by a spring in the opposite direction, to a position in which the rotor is again in a safe position.

Thus, with this known safety means the half-shaft is moved to its armed position and back to its safe position with the aid of two mutually different drive devices, each of which drives the half-shaft in a mutually opposite direction. This renders the construction of the known arrangement complicated and also increases the risk of a malfunction.

The U.S. Pat. No. 3,170,404 teaches a further safety means of this kind, in which an arming rotor is normally locked through the engagement of a half-shaft in a recess located in the rotor. In order to release the rotor, it is necessary to rotate the half-shaft out of engagement with the recess, to the aforesaid safe position of the rotor, and also to rotate the half-shaft about its axis at a predetermined speed. If, in the other hand, the half-shaft moves with excessive speed, i.e. rushes, there is sufficient time for the half-shaft to re-enter the recess in the rotor so as to prevent the rotor from rotating, i.e. to restore the rotor in its safe position. With this arrangement, however, there is the risk that the rotor, if biassed, may have time to rotate slightly before the quickly moving half-shaft is able to enter the recess thereby preventing the rotor from being restored to its safe position.

SUMMARY OF THE INVENTION

It is the object of this invention to provide a safety means of the kind described in the introduction in which the armed and safe positions are achieved with the aid of one single drive means, and which will provide a safety facility that is more reliable than the known means of this kind. This object is achieved with a safety means that has the characterizing features set forth in the following claim 1.

Further developments are set forth in the depending claims. According to the invention there is provided in the arming rotor a further recess which is so dimensioned that if the half-shaft rotates at an excessive, or impermissible, speed it is able to rotate into the further recess and therewith place the rotor in its safe position. This ensures that the rotor will be made safe even if the half-shaft should rotate so quickly that it is unable to enter the first recess before the rotor begins to rotate.

DESCRIPTION OF A PREFERRED EMBODIMENT

Figure 1:
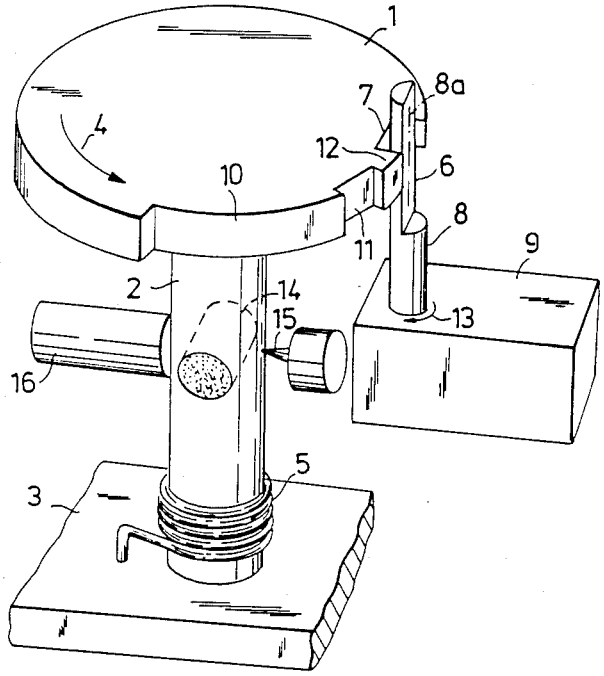
FIG. 1 is a perspective view of a first embodiment of a safety means according to the invention.

FIG. 1 illustrates a disc-shaped arming rotor 1 which is carried rigidly by a central shaft 2. The shaft 2 is journalled for rotation in a frame member 3 forming part of an arming system housing (not shown) which accomodates an ordnance projectile fuze. The rotor 1 is biassed in the direction of the arrow 4 by drive means in the form of a coil spring 5, one end of which is attached to the shaft 2 and the other end to the frame member 3. The rotor 1 is normally held against rotation by means of a locking device, often referred to as a break off means, which has the form of a half-shaft 6 which extends parallel with the shaft 2 and which is moved into engagement with a radial recess 7 provided in the periphery of the rotor 1. The half-shaft 6 is of semi-circular cross-section and constitutes an extension of a cylindrical shaft 8 which is journalled for rotation in a drive means (not shown) in the form of a conventional clock mechanism 9 of the kind taught by the aforesaid U.S. Pat. No. 3,170,404.

The recess 7 has a peripheral extension which slightly exceeds the diameter of the half-shaft 6 and a constant radial depth which equals approximately half the diameter of the half-shaft. The recess 7 passes stepwise on one side thereof into a second radial recess 10 which has a constant depth slightly less than half the diameter of the half-shaft. The recess 10 extends around the rotor through practically 90 degrees of arc and forms an accurate guide surface or slide surface for the half-shaft during rotation of the rotor to its armed position. Located in the recess 10 at a distance from the first recess 7, which extends through a distance equal to about half of the radius of the half-shaft 6, is a third radial recess 11, the peripheral extension of which slightly exceeds the diameter of the half-shaft and the depth of which is constant along the whole of its peripheral extension, this depth being equal approximately to half the radius of the half-shaft. Thus there is formed between the recesses 7 and 11 a substantially radial wall element 12 which has a free edge surface that forms the entrance to the recessed guide surface 10. This arrangement is such that when the half-shaft 6 is rotated about its axis in the direction of the arrows 13 in FIGS. 1 and 2 it is able to turn from the recess 7 into the recess 11.

As will be understood from the aforegoing, the centre axis 8*a* of the shaft 8 is level with the free edge surface of the wall element 12. The shaft 8 is normally positioned so that the curved surface of the half-shaft faces towards the recess 7, is illustrated in FIG. 1 and in position A in FIG. 2. Consequently, when the half-shaft 6 is rotated through one half revolution it will be located outside the free edge surface of the wall element 12, i.e. in a position in which the rotor is free to rotate in the direction of the arrow 4.

Figure 2:
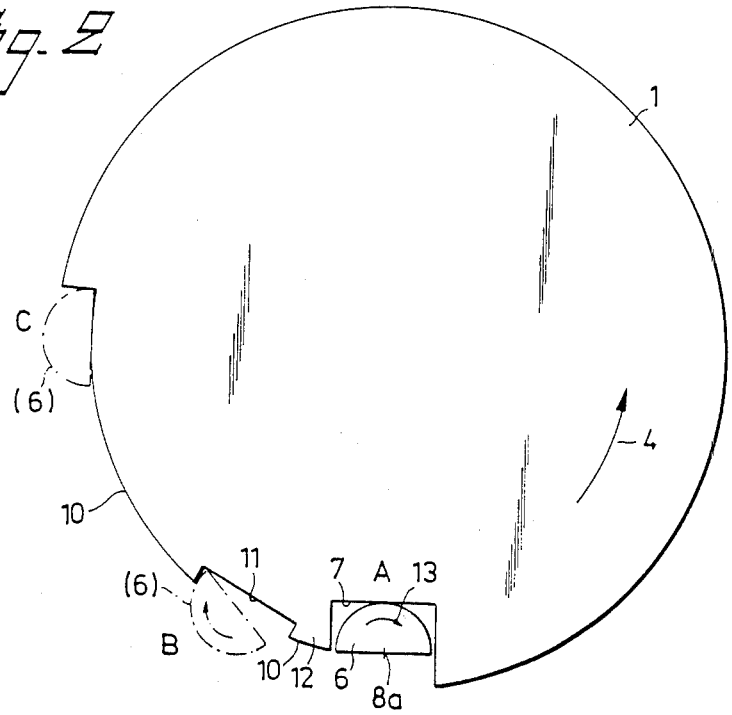
FIG. 2 is a top plan view, in larger scale, of the safety means illustrated in FIG. 1.

The rotor shaft 2 accommodates in a known manner a detonator 14 which in the position illustrated in FIG. 1 and the position A in FIG. 2 is offset in a safe position, out of line with a firing pin 15 in the fuze and a booster charge 16 for detonating an explosive charge located in the projectile or mine to which the fuze is fitted. When the rotor 1 is rotated through 90 degrees, the detonator 14 will move correspondingly to a position in which it is in line with the firing pin 15 and the booster charge 16, thereby completing an explosive train that leads to the aforesaid explosive charge.

Since this arrangement of the detonator 14, the firing pin 15 and the booster charge 16 is well known to those skilled in this art and forms no part of the present invention it will not be described in greater detail here.

The safety means functions in the following manner: When the clock mechanism 9 functions normally, the half-shaft 6 will lie outside the free edge surface, of the wall part 12 when rotated about its axis through 180 degrees in the direction of the arrow 13, so as to disengage the rotor and allow the rotor to be rotated in the direction of the arrow 4 under the action of the rotor drive spring 5. When the half-shaft 6 rotates at a normal speed there will be insufficient time for the half-shaft to enter the recess 11 as the rotor rotates, and the half-shaft will slide along the whole of the guide recess 10 until it strikes the distal edge of said recess, as illustrated at position C in FIG. 2. Thus in this position the rotor has rotated through 90 degrees to its armed position, in which the detonator 14 is located in its explosive train. The fuze is now armed.

If, on the other hand, the clock mechanism is faulty, i.e. if the half-shaft 6 rotates about its axis at an excessively high speed ("rushes") the half-shaft 6, subsequent to having clambered up the free edge surface of the wall element 12, will be rotated down into the recess 11, to the position B shown in FIG. 2. The rotor 1 is therewith locked against further rotation, i.e. the rotor is again in its safe position.

For the sake of illustration, the half-shaft 6 is shown in FIG. 2 in various positions A, B and C around the periphery of the rotor. It will be obvious, however, that the half-shaft 6 is only able to rotate about its axis at one and the same mounted location and that the various positions A, B and C around the rotor periphery are achieved through the rotation of the rotor, although this has not been shown clearly in FIG. 2 for illustration reasons.

Figure 3:
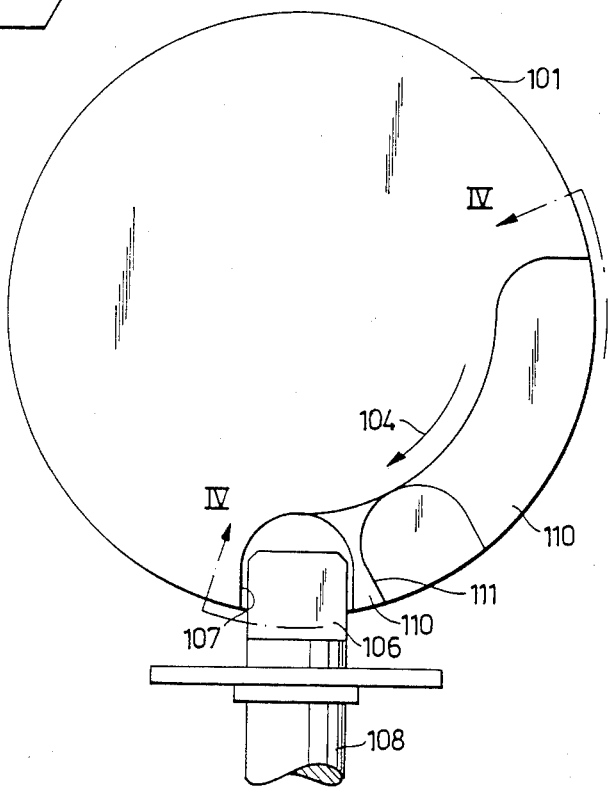
FIG. 3 is a top plan view of a second embodiment of the invention.
Figure 4:
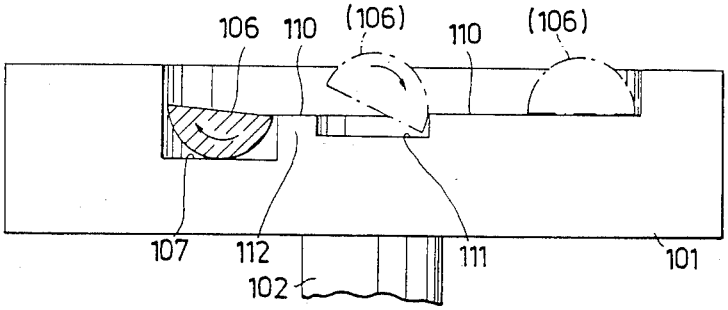
FIG. 4 is an extended view taken on the line IV—IV in FIG. 3.

FIGS. 3 and 4 illustrate an alternative embodiment of the invention. Whereas the recesses 7, 10 and 11 in the embodiment of FIGS. 1 and 2 face radially away from the centre of the rotor, the corresponding recesses 107 and 110 and 111 of the alternative embodiment face upwardly instead, in a direction which is parallel with the rotor axis 102. The half-shaft 106 of this embodiment is oriented radially in relation to the rotor 101. The manner in which the alternative embodiment of the safety arrangement operates is fully analogous with that of the embodiment first described.

Thus, when functioning normally, the half-shaft 106 will clamber up the wall element 112 and slide along the guide surface 110, of the rotating rotor to the distal end of said surface, o.f. position C″ in FIG. 4. In the event of a malfunction, the half-shaft 106 will clamber over the wall part 112 and enter the recess 111, thereby making the rotor safe.

Of the two embodiments described in the aforegoing with reference to the drawings, the embodiments according to FIGS. 3 and 4 are the preferred embodiments, since fuzes for gun-barrel ammunition afford but limited space to break off means and restraining mechanisms, and hence a radially mounted break off means is the one most often used.

We claim:

1. A safety means for an ordnance fuze, comprising an arming rotor (1) which can be rotated from a safe position (A) to an armed position (C) and which is held in its safe position by a locking device (6) in engagement with a first recess (7) located in the periphery of the rotor, said locking device having the form of a shaft of substantially semicircular cross-section, i.e. a half-shaft, and which safety means further comprises a first drive device (9) which is operative to rotate the half-shaft out of said first recess in a given rotational direction (13), to a position in which the rotor is free to rotate, and a second drive device (5) which is operative to rotate the rotor in its free rotatable position from the safe position of the rotor to the armed position thereof, with the half-shaft sliding against a guide surface (10) on the rotor during rotation of said rotor, characterized in that the rotor (1) has located in said guide surface (10) a second recess (11) in the vicinity of the first recess (7), which is so dimensioned that if the half-shaft (6) rotates about its axis at an excessively high, impermissable speed, said half-shaft is able to rotate into said second recess so as to automatically restore the rotor to its safe position.

2. A safety means according to claim 1, characterized in that the second recess (11) is separated from the first recess (7) by means of a wall element (12); and in that the half-shaft (6) is able to clamber-up over the wall element in order to rotate down into the second recess.

3. A safety means according to claim 1, characterized in that the half-shaft (6) is arranged to rotate about its axis through more than one half revolution but through less than a full revolution, preferably through about three quarters of a revolution.

* * * * *